United States Patent [19]

Sirel

[11] 4,247,838

[45] Jan. 27, 1981

[54] EXPANSION JOINT FOR WAVE GUIDES

[75] Inventor: Michel Sirel, Paris, France

[73] Assignee: Les Cables de Lyon, Lyons, France

[21] Appl. No.: 24,143

[22] Filed: Mar. 26, 1979

[30] Foreign Application Priority Data

Apr. 7, 1978 [FR] France ..... 78 10480

[51] Int. Cl.[3] ..... H01P 1/06; H01P 1/30

[52] U.S. Cl. ..... 333/254; 333/33; 333/208; 333/257

[58] Field of Search ..... 333/239, 241, 248, 256, 333/254, 255, 257, 12, 33, 35, 208

[56] References Cited

U.S. PATENT DOCUMENTS

| | | | |
|---|---|---|---|
| 2,473,834 | 6/1949 | Tuller | 333/256 |
| 2,523,320 | 9/1950 | Mieher et al. | 333/257 |
| 2,837,723 | 6/1958 | Krantz et al. | 333/256 |
| 4,020,431 | 4/1977 | Saunders | 333/256 |

FOREIGN PATENT DOCUMENTS

| | | | |
|---|---|---|---|
| 2609076 | 9/1977 | Fed. Rep. of Germany | 333/995 |

*Primary Examiner*—Marvin L. Nussbaum

*Attorney, Agent, or Firm*—Sughrue, Rothwell, Mion, Zinn and Macpeak

[57] ABSTRACT

The expansion joint includes a first component and a second component which have the same inside dimensions as the wave guide and are free to move longitudinally with respect to each other, the first component having exclusively a wave guide structure, the second component including a trap positioned at least partially between said components and outside the first component, the electric length of said trap being equal to half the wavelength of the central frequency transmitted by the wave guide, said components being separated longitudinally at the trap by a distance which varies when the length of the wave guide varies. The trap can be folded to reduce its bulk.

Application to long wave guides.

6 Claims, 1 Drawing Figure

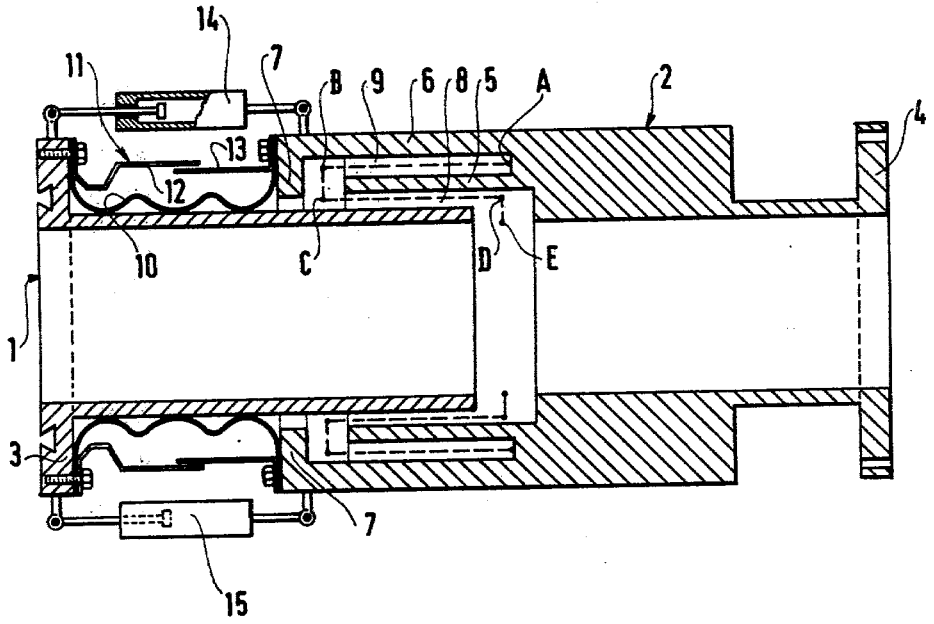
14
11
7
B
9
6
8
5
A
2
4
13
12
10
C
D
E
1
3
7
15

EXPANSION JOINT FOR WAVE GUIDES

FIELD OF THE INVENTION

This invention relates to expansion joints for wave guides, and in particular for wave guides for television transmitters.

BACKGROUND OF THE INVENTION

When very long wave guides are disposed in ambient conditions subject to large differences in temperature, as in the case of natural variations in temperature, expansion stresses are produced in the wave guides. This is the case in particular for television transmitters, where the wave guides are made of aluminum and are placed along a steel structure, e.g. a pylon, and where difference in temperature of 50° C. are currently found. For a length of 100 meters, the differential expansion between the wave guides and the steel structure is then sixty millimeters.

A known solution consists in connecting the wave guide to the transmitter by giving it a very large radius of curvature at the foot of the pylon; expansion then affects the radius of curvature without deforming the wave guide too much; in such a solution, free expansion of the wave guide must be allowed for by not fixing it rigidly to the pylon at any point between the foot and the top of the pylon.

Flexible wave guides are also known which allow for differences in expansion; these wave guides are generally of small cross-section. They have relatively high attenuation and they are difficult to manufacture with a large cross-section, as is more particularly required for wave guides for television transmitters.

The invention aims to provide an expansion joint which accommodates the variations in length of a wave guide that is subject to large variations in temperature.

The invention also aims to provide an expansion joint in which the standing wave ratio remains low throughout the whole expansion range.

A further aim of the invention is to seal the expansion joint when the wave guide is pressurised.

SUMMARY OF THE INVENTION

An expansion joint according to the invention includes first and second aligned components which have the same inside dimensions as the wave guide and which are free to move longitudinally with respect to each other, the first component comprising a tube, while the second component includes a trap positioned at least partially between said components and outside the first component, the electric length of said trap being equal to half the wavelength of the central frequency transmitted by the wave guide, said components being separated longitudinally at the trap by a distance which varies when the length of the wave guide varies.

BRIEF DESCRIPTION OF THE DRAWING

The invention will be better understood from the following description of an embodiment illustrated in the accompanying FIGURE which shows a longitudinal expansion joint for a rectangular wave guide.

DESCRIPTION OF THE PREFERRED EMBODIMENT

The expansion joint includes first and second rectangular wave guide components, 1 and 2 respectively, each component including a fixing flange, 3 and 4 respectively, at one end. The components 1 and 2 are not integral with each other and can move longitudinally with respect to each other along their axis. The first component 1 is a simple tube of rectangular section, while the second component 2 includes a folded back trap in each of its large sides, each trap being constituted by a first branch 5 which faces the outer surface of the first component 1 and a second branch 6 radially beyond the first branch, said second branch including an in-turned lip 7 at its end facing the outer surface of the first component and covering the end of the first branch 5.

A first transmission line 8 is therefore obtained between the first component 1 and the first branch 5 and a second transmission line 9 is obtained between the branches 5 and 6. The average electric length of the first transmission line is CD and the average electric length of the second transmission line is AB.

The trap is folded to reduce its bulk. Its average electric length corresponds to the path A B C D E. The electric lengths AB and CD are close to a quarter wavelength, while the electric lengths BC and DE are short with respect to a half wavelength, so that the short-circuit which occurs at A is shifted to E. For example, at a frequency of 600 MHz, the half wavelength is 25 centimeters and the sum of the electric lengths BC and DE is about 2.5 to 3 centimeters. The components 1 and 2 move with respect to each other as a function of the expansion of the run of the wave guides; but the electric length of only the transmission line CD is modified, which causes variation in the impedance shifted to point E. Adopting a high ratio between the impedances of the transmission lines 8 and 9, the impedance variation is negligible over a fairly wide frequency band, of about 10% of the central frequency, i.e. ±5% about the central frequency transmitted by the wave guide. The transmission lines 8 and 9 have different widths and, consequently, different impedances. The second transmission line 9 is wider than the first transmission line 8; the ratio between their widths is about 3:1 or 4:1; the impedance of the second transmission line 9 is therefore 3 or 4 times greater than that of the first transmission line 8.

To further reduce the bulk of the trap, and hence the lengths of the transmission lines 8 and 9, these transmission lines can be filled with a dielectric material such as polyethylene, for example.

In order not to establish a standing wave ratio with the trap, the path CDE must be equivalent to the path ABC and equal to a quarter wavelength; of course, if some parts of these paths pass through the polyethylene or through the air, this should be taken into account.

By way of example, for a rectangular wave guide whose dimensions are 43 cm×21.5 cm, at a central frequency of 500 MHz, a variation of 50 millimeters can be obtained between the first component 1 and the second component 2 of the expansion joint without affecting the standing wave ratio. In television band IV, the standing wave ratio of an expansion joint is less than 1.02 over a 60-MHz band width.

It is necessary to have a trap in the large sides only of the expansion joint, the inside dimensions of these sides being obviously the same as those of the wave guides to which the expansion joint is fixed. However, the small sides of the components of the expansion joint also move with respect to one another, and to avoid friction between the metal parts a plate plastics material can be inserted between these parts.

The expansion joint is sealed by means of a flexible rubber part 10 fixed all round the expansion joint firstly to the flange 3 of the first component and secondly to the lip 7 of the second component; a metal hood 11 which surrounds the first component is constituted by two portions 12 and 13 which can move with respect to each other when the components of the expansion joint move and provides mechanical protection and positioning of the rubber part. Indeed, wave guides such as those used in television transmission are filled with dry compressed air, the normal pressure being about 30 g/cm$^2$; under the effect of the pressure, the india rubber part moves away from the expansion joint, and if there is no metal hood it must itself withstand the pressure.

The FIGURE shows two screw jacks 14 and 15, each fixed to the components 1 and 2 of the expansion joint. These jacks fix the relative positions of the components 1 and 2 of the expansion joint at ambient temperature and in particular at the temperature at which assembly is carried out; after assembly, these jacks become useless and are removed.

By way of example, in the application to television transmission, a 200-meter column of wave guides includes successively, starting from the top: at the 200-meter level, an expansion joint; at the 130-meter level, a weight support and, below an expansion joint, at the 60-meter level, another weight support and a third expansion joint; at the bottom of the pylon, a third weight support. Of course, the vertical forces applied by the weight supports are held by lacing bars of the pylon provided for that purpose. The column of wave guides is divided into three sections, each weight support having to bear the weight of one third of the column, i.e. about 2.5 tonnes for a rectangular guide made of aluminum and having dimensions of 43 cm×21.5 cm. The use of expansion joints avoids the necessity of having a large radius of curvature in the wave guide at the foot of the pylon to connect the pylon to the actual transmitter. Of course, since the transmitter is several meters away from the pylon, the wave guide which connects it to the pylon may also include one or more expansion joints.

It must be understood that the invntion is not limited to expansion joints for rectangular wave guides, whatever their dimensions may be, and applies in general to all types of wave guide and in particular to circular wave guides and in the latter case the trap is quite obviously circular.

I claim:

1. An expansion joint for wave guides, said expansion joint including first and second aligned components which have the same inside dimensions as the wave guide and which are free to move longitudinally with respect to each other, the improvement wherein said first component comprises a tube, said second component includes a trap positioned at least partially between said components and radially outside the first component, the electric length of said trap being equal to half the wavelength of the central frequency transmitted by the wave guide, and means for separating said components longitudinally at the trap by a distance which varies as the length of the wave guide varies, and wherein said trap is folded so as to obtain two transmission lines which have the same electric length, and said trap includes a first transmission line constituted by a space comprised between the first component and the first longitudinal branch of the second component, a second transmission line constituted by a space comprised between said first branch and said second longitudinal branch, one of whose ends has a radially inwardly turned lip facing said other surface of said first component and covering one end of said first branch, and wherein said second transmission line is wider than that of the first transmission line and having therefore a greater impedance.

2. An expansion joint according to claim 1, wherein a flexible insulating part is fixed on one side to a flange of said component and the other side to said lip of said second component so as to provide dust proof sealing therebetween.

3. An expansion joint according to claim 2, wherein a metal hood completely covers said flexible insulating part and said hood includes two parts which are free to slide with respect to each other.

4. An expansion joint according to claim 1, wherein its cross-section is rectangular and the trap is mounted on each of the large sides of said rectangular cross-section.

5. An expansion joint according to claim 4, wherein a plate of plastics material is interposed between each of the small sides of the first and second components.

6. An expansion joint according to claim 1, wherein both components are connected together by jacks so as to keep them at a predetermined distance apart during installation, said distance being a function of the ambient temperature, and means for removing said jacks when the components are installed in the wave guide.

* * * * *